US005441259A

United States Patent [19]

Stevenson

[11] Patent Number: 5,441,259

[45] Date of Patent: Aug. 15, 1995

[54] COIN OPERATED JACKPOT MACHINE

[76] Inventor: Marion Stevenson, 1810 W. State St., Apt. 219, Boise, Id. 83702

[21] Appl. No.: 283,544

[22] Filed: Aug. 1, 1994

[51] Int. Cl.[6] ..... A63F 5/04

[52] U.S. Cl. ..... 273/143 R; 273/143 D; 273/142 JD

[58] Field of Search ..... 273/138 R, 142 R, 143 R, 273/143 C, 143 D, 143 E, 142 A, 142 B, 142 C, 142 JD, 142 H, 142 JA, 144 R

[56] References Cited

U.S. PATENT DOCUMENTS 4,262,906 4/1981 Heywood ..... 273/143 R
4,715,604 12/1987 Okada ..... 273/143 R

FOREIGN PATENT DOCUMENTS 801956 8/1936 France ..... 273/143 R
404904 1/1934 United Kingdom ..... 273/143 R
644818 10/1950 United Kingdom ..... 273/143 R
894243 4/1960 United Kingdom ..... 273/143 R

*Primary Examiner*—V. Millin
*Assistant Examiner*—William M. Pierce

[57] ABSTRACT

A double match jackpot with (2) separate identical operating mechanisms in the machine is the invention. The two (2) identical mechanisms operate independently with no set combinations of play. Each play is with random results. A winning play is not determined by the number of plays made previously. The matching of two (2) identical symbols on pairs of facing discs determines a win. Operating sections can be attached separately to other identical operating sections to increase the odds in any play of the machine. Odds can be increased also by addition of identical symbols to the edges of facing discs.

1 Claim, 9 Drawing Sheets

COIN OPERATED JACKPOT MACHINE

BACKGROUND OF THE INVENTION

The invention is a jackpot game involving matching symbols to determine a win. There are no set sequences of plays to determine jackpots based on number of plays made previously. Any play made can determine a win. Pairs of facing discs with identical symbols on them rotate at random with no gears to control the rotation. Any symbol on a disc can match any symbol on a facing disc on every play made on the machine and determine a win. Adjoining sections can be attached separately to other identical operating sections to increase the odds in any play of the machine. Odds can be increased also by addition of identical symbols to the edges of facing discs.

Other jackpot machines operate with rotation controlled by gears. Wins are determined by set sequences. Wins only occur when a predetermined number of plays are made to allow a win. There is no random rotation to allow a win without a predetermined number of plays made previously to allow a win. They operate on a principle similar to lottery rub off cards where a predetermined number of winning cards are printed. A predetermined winning card has to be purchased to win. Other jackpot machines and lottery rub off cards allow no random chance wins when each win is predetermined by either the number of plays made previously or by purchase of a printed card that is predetermined to be a winning card.

SUMMARY OF THE INVENTION

The double match jackpot machine has two (2) identical operating mechanisms that operate independently of each other. The machine operates without a predetermined number of plays made previously to allow a win. Every play made is a random play and allows a win without any predetermined number of plays made previously to allow a win.

Pairs of facing discs with identical symbols on their edges rotate and determine a win when two (2) symbols match. There are no gears to regulate the rotation of the discs. The discs are attached to discs bars through holes in the centers of the discs. The discs rotate on the discs bars at random with no restraint.

Pairs of facing discs have discs levers attached to their facing surfaces that are engaged by the coin slots elevator springs and braces during the withdrawal of the coin slots during play. This engagement during withdrawal of the coin slots during play causes random rotation of the discs in a clockwise direction. The rotation of pairs of facing discs aligns two (2) symbols. The alignment of two (2) symbols that match on pairs of facing discs determine a win.

There are two (2) methods to increase odds in the machine, Attachment rods can be attached through coin slots handles hollows to allow more than one coin slot to operate in a play. The increase in odds depends upon how many identical sections are attached together for a play. Identical symbols can be added also to the edges of pairs of facing discs to increase odds. The increase in odds depends upon how many symbols are added to the edges of the facing discs.

DESCRIPTION OF THE PREFERRED EMBODIMENT

Figure 1:
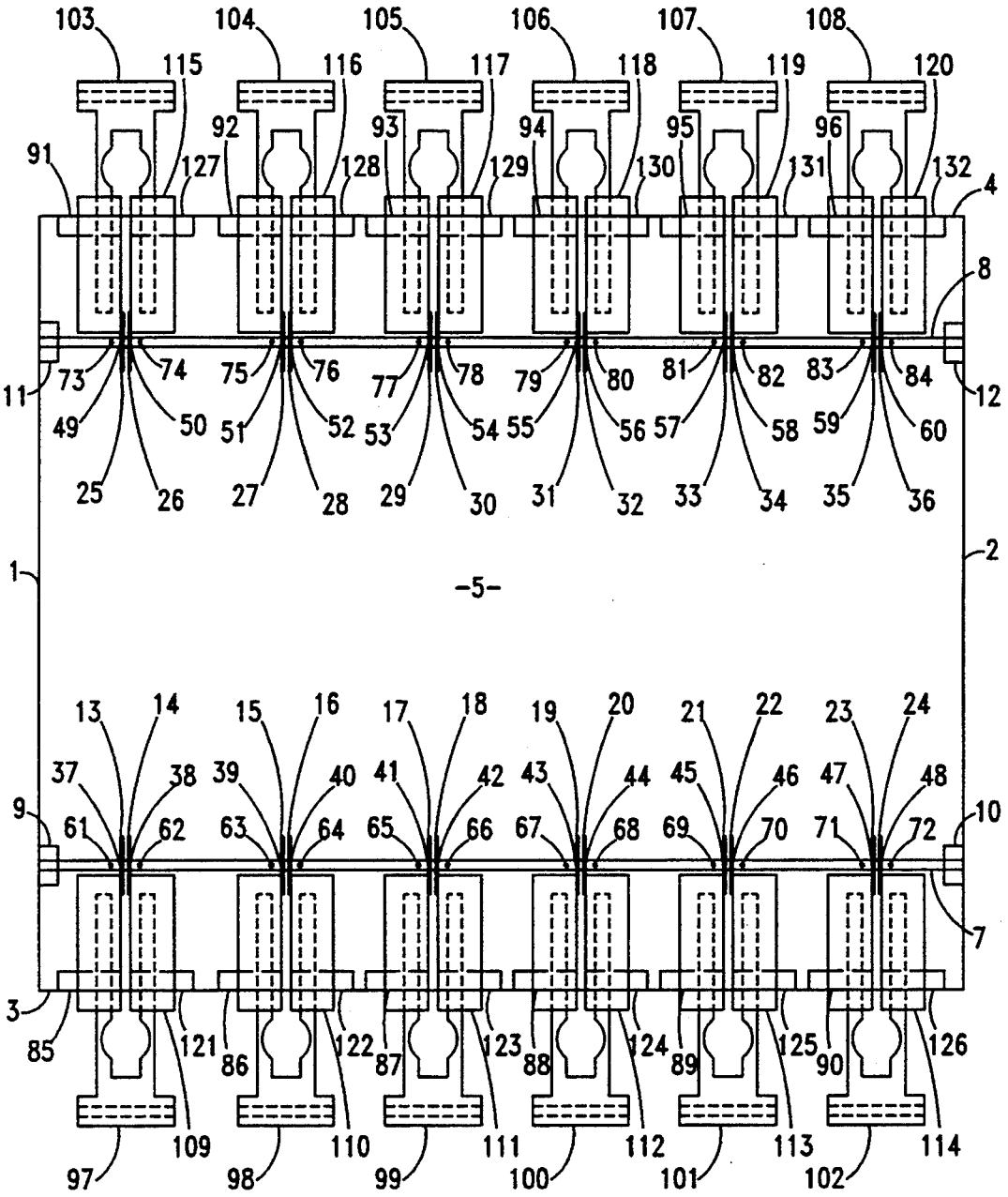
FIG. 1 is a perspective top view of the double match jackpot with the top of the machine removed to show the double operating mechanisms that operate independently of each other from the front side and from the rear side. Shown in each mechanism are the discs and discs bars that the discs rotate on. Discs bars are supported by discs bars supports attached to the left side and to the right side. The discs bars pins are attached to the discs bars on each side of pairs of facing discs to hold them in alignment with each other. Shown are the coin slots containers that extend through the coin slots containers entryways into the machine. The coin slots are contained in the coin slots containers. The coin slots containers holders that are attached to the inside of the front side and to the inside of the rear side of the machine hold the coin slots containers.
Figure 5:
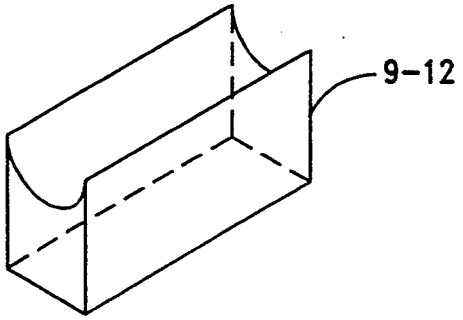
FIG. 5 is a view of the discs bars supports showing the grooves in the top that support the discs bars.
Figure 6:
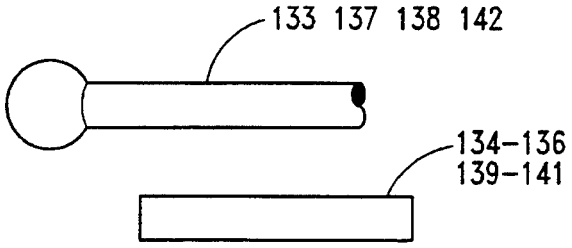
FIGS. 6 and 6A are a view of the attachment rods that are attached to identical operating sections to increase odds.
Figure 7:
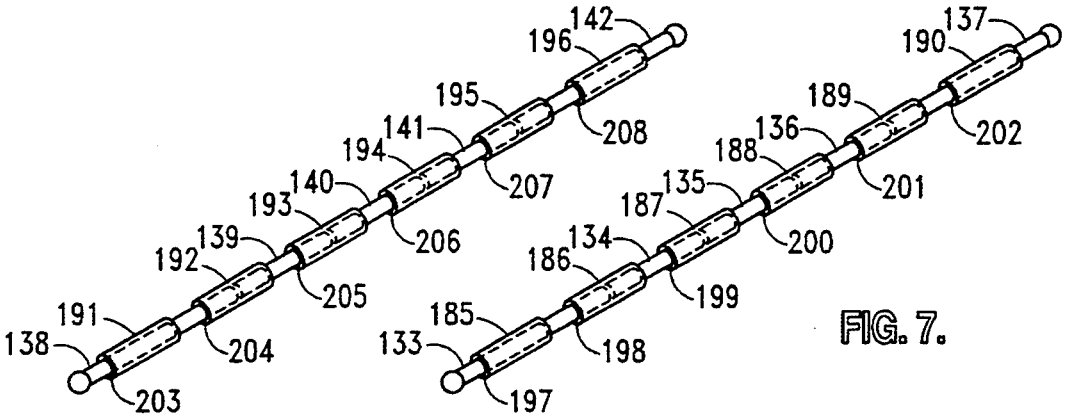
FIGS. 7 and 7A are a perspective view of the attachment of the attachment rods attached through the hollows in the coin slots handles.
Figure 12:
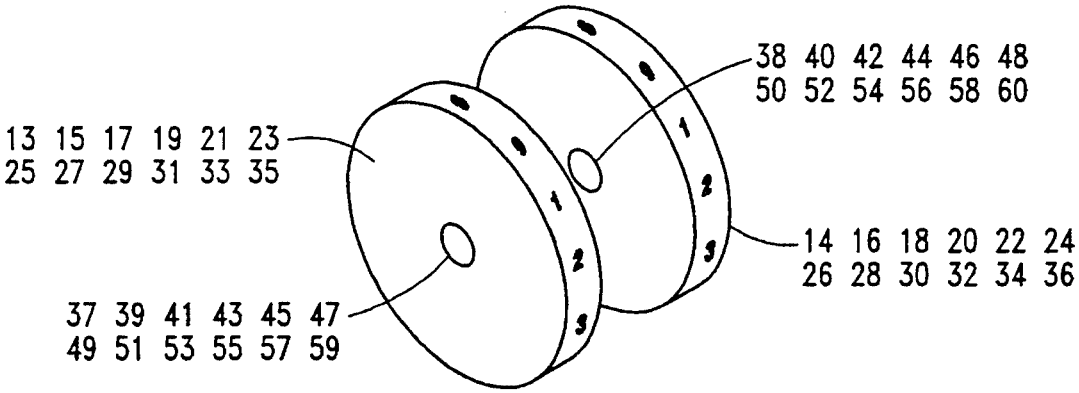
FIG. 12 is a view of pairs of facing discs with the arrangement of identical symbols on the discs edges.

Referring to FIG. 1 there is illustrated a top view of the machine with the top of the machine removed. Shown are the front side 3 and rear side 4 with identical mechanisms that operate independently of each other. Each side has six (6) separate sections that can be played individually or can be attached to one or more adjoining sections to be played together as one unit in a play. Increased odds are attained according to how many sections are attached together in a play. There are twenty-four (24) discs 13–26 attached to two (2) discs bars 7–8 through holes in the centers of the discs. The discs bars are held in place by grooves in the four (4) discs bars supports 9–12 as shown in FIG. 5. The discs bars supports are attached to the inside of the left side and to the inside of the right side. The discs are held in pairs of facing discs by twenty-four (24) discs bars pins 61–84 that are attached to the discs bars. The pairs of facing discs have identical symbols on the edges of the discs as shown in FIG. 12. Increased odds are attained according to how many symbols are added to the edges of pairs of facing discs. There are twelve (12) coin slots containers 109–120 attached to the front side and to the rear side to hold the coin slots. The twelve (12) coin slots containers enter the machine through twelve (12) coin slots containers entryways 85–96. The twelve (12) coin slots containers are supported inside the machine by twelve (12) coin slots container supports 121–132 attached to the inside of the front side and to the inside of the rear side.

Figure 3:
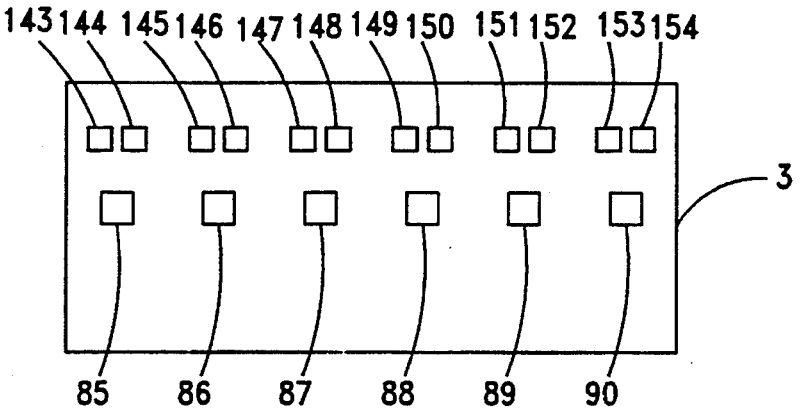
FIG. 3 is a view of the front side showing the front side coin slots containers entryways and front side symbols viewing ports.
Figure 4:
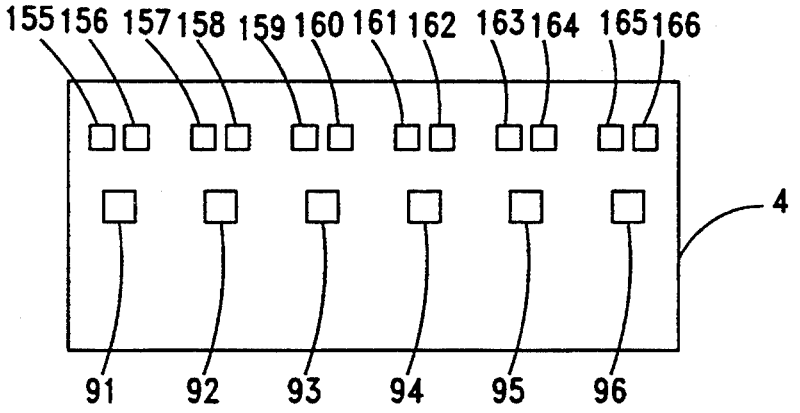
FIG. 4 is a view of the rear side showing the rear side coin slots containers entryways and rear side symbols viewing ports.
Figure 8:
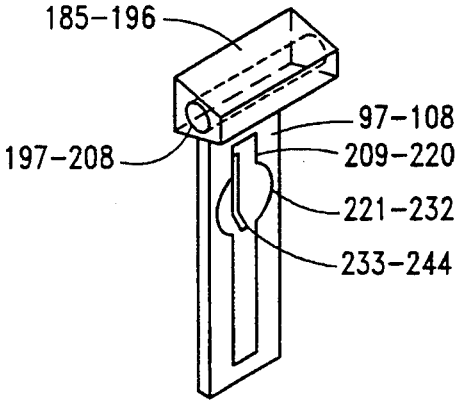
FIG. 8 is a perspective view of the coin slots showing the coin slots handles and coin slots handles hollows. Shown are the coin slots cutouts with the elevated coin slots elevator springs and braces attached to the bottoms of the coin slots coin placements.
Figure 6A:
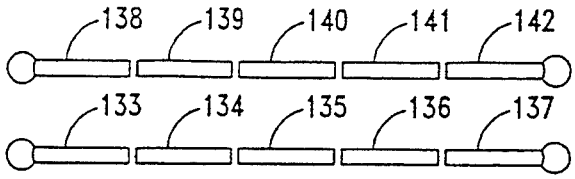
Figure 7A:
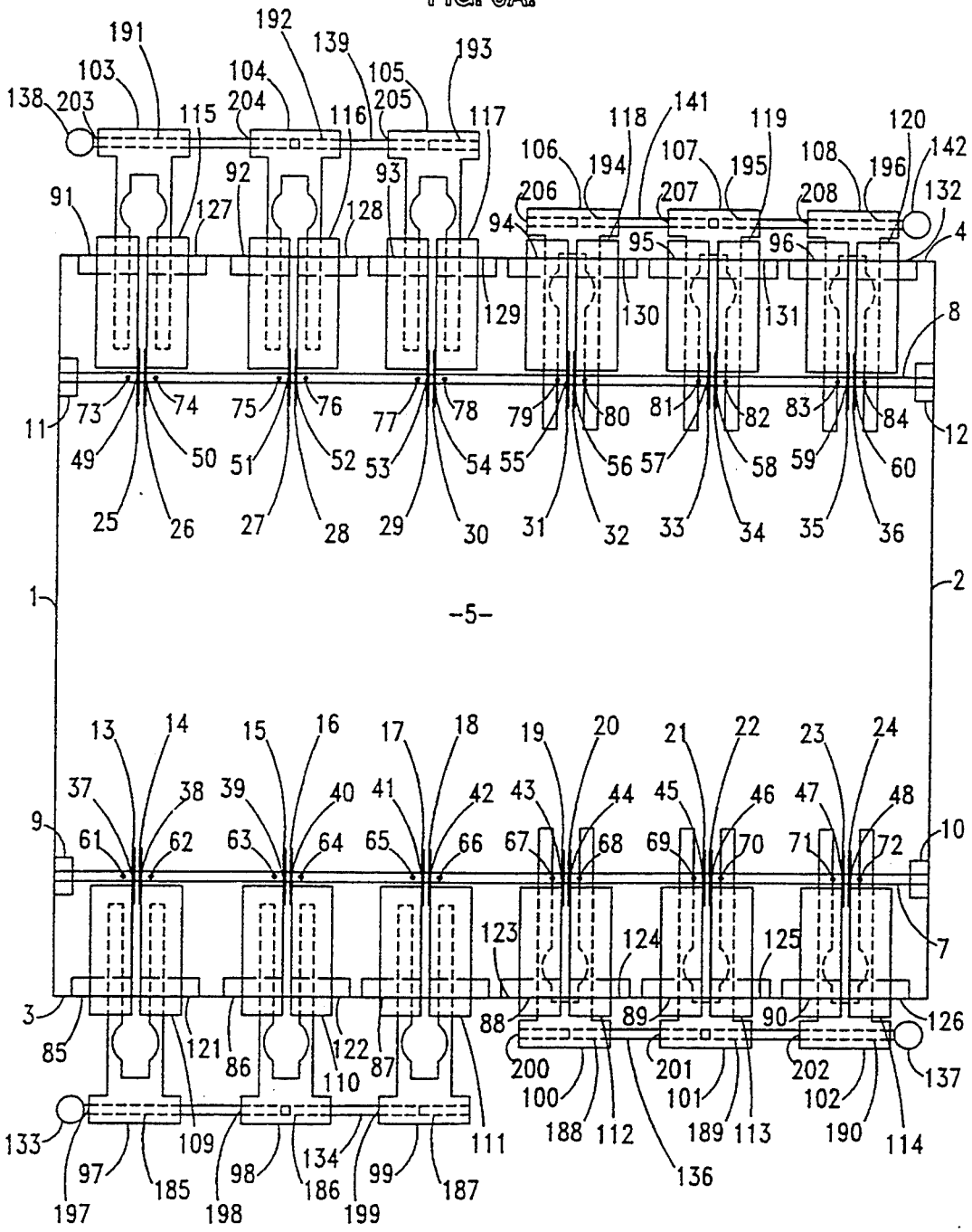

Referring to FIG. 8 there is illustrated the coin slots that are advanced inside the machine and withdrawn in movements to play the machine. These movements of the coin slots cause rotations in pairs of facing discs. The rotated symbols on pairs of facing discs are shown in symbols viewing ports 143–154 for the front side shown in FIG. 3. FIG. 3 shows the coin slots containers entryways 85–90 for the front side. The rotated symbols on pairs of facing discs are shown in symbols viewing ports 155–166 for the rear side as shown in FIG. 4. FIG. 4 shows the coin slots containers entryways 91–96 for the rear side. FIG. 8 shows the coin slots coin placements 221–232 without coins placed in them. The coin slots elevator springs and braces 233–244 attached to the bottoms of the coin slots coin placements are shown in elevated positions. Shown are the coin slots handles 185–196 and coin slots handles hollows 197–208 through which are attached the attachment rods 133–142 shown in FIG. 6A. The attachment rods are attached as shown in FIG. 7A. Front side sections on the left side show front coin slots 97–99 attached by front attachment end rod 133 and front attachment inner rod 134 to join these three (3) sections together. They are illustrated without coins inserted to play these three (3) sections. Front attachment inner rod 135 is removed to prevent attachment of the three (3) sections on the left side to the three (3) sections on the right side. Front side sections on the right side show front coin slots 100–102 attached by front attachment end rod 137 and front attachment inner rod 136 to join these three (3) sections together. They are illustrated in play inside the machine together. Rear side sections on the left side show rear coin slots 103–105 attached by rear attachment end rod 138 and rear attachment inner rod 139 to join these three (3) sections together. They are illustrated without coins inserted to play these three (3) sections. Rear attachment inner rod 140 is removed to prevent attachment of the three (3) sections on the left side to the three (3) sections on the right side. Rear side sections on the right side show rear coin slots 106–108 attached by rear attachment end rod 142 and rear attachment inner rod 141 to join these three (3) sections together. They are illustrated in play inside the machine together. The odds are increased depending upon how many attachment rods are attached during play of the machine.

Figure 9:
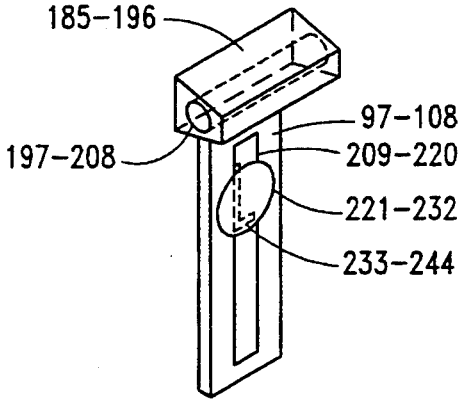
FIG. 9 is a view of the coin slots as shown in FIG. 8 with coins placed in the coin slots coin placements to depress the coin slots elevator springs and braces from the elevated positions.
Figure 10:
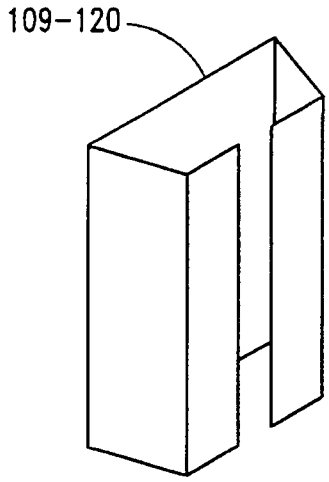
FIG. 10 is a view of the coin slots containers.
Figure 11:
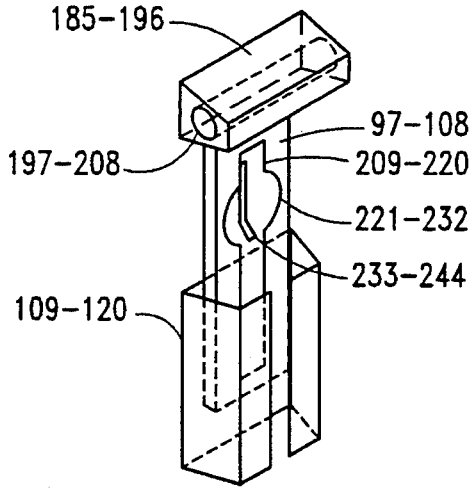
FIG. 11 is a perspective view showing the coin slots contained inside the coin slots containers.

Referring to FIG. 9 there is illustrated the coin slots as shown in FIG. 8. In FIG. 9 the coin slots coin placements are shown with coins placed in them to depress the coin slots elevators and braces. The coin slots elevator springs and braces have to be depressed by coins to allow the coin slots to enter the machine. FIG. 10 shows the coin slots containers. The coin slots contained in the coin slots containers through which they enter the machine are shown in FIG. 11.

Figure 13:
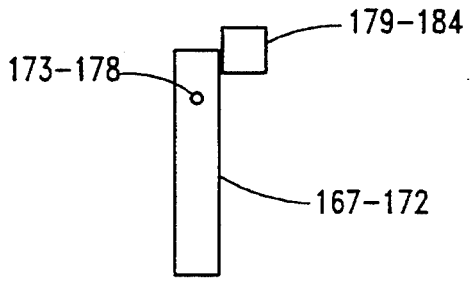
FIG. 13 is a view of the discs levers that are attached to the inside surfaces of pairs of facing discs. Shown are the discs levers pivots that attach the discs levers to the discs. Shown are the discs levers stops that are attached to the discs to control the pivoting of the discs levers during play of the machine.
Figure 14:
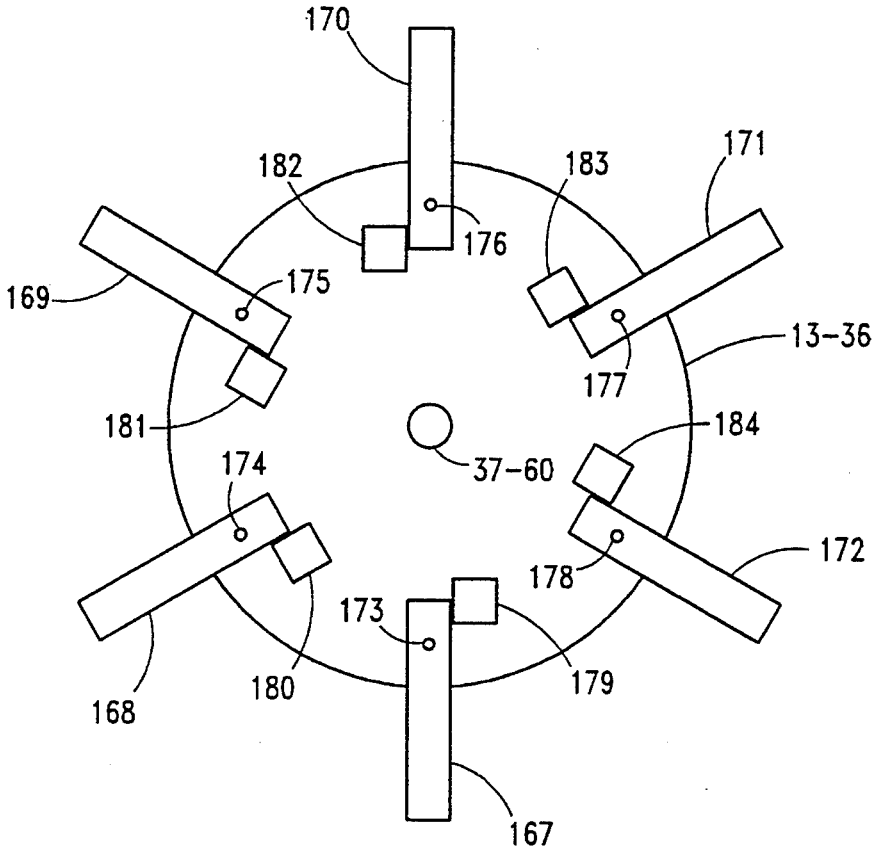
FIG. 14 is a perspective view of the facing sides of pairs of facing discs and shows the attachment of the discs levers, discs levers pivots and discs levers stops to the facing surfaces of the discs.

Referring to FIG. 12 there is illustrated pairs of facing discs with identical symbols on their edges. Pairs of facing discs have attached to their facing surfaces the discs levers 167–172 shown in FIG. 13. The discs levers are attached to facing surfaces of pairs of facing discs by discs levers pivots 173–178 as shown in FIG. 14. FIG. 14 shows the discs levers stops 179–184 that control the pivoting of the discs during play of the machine.

Figure 15:
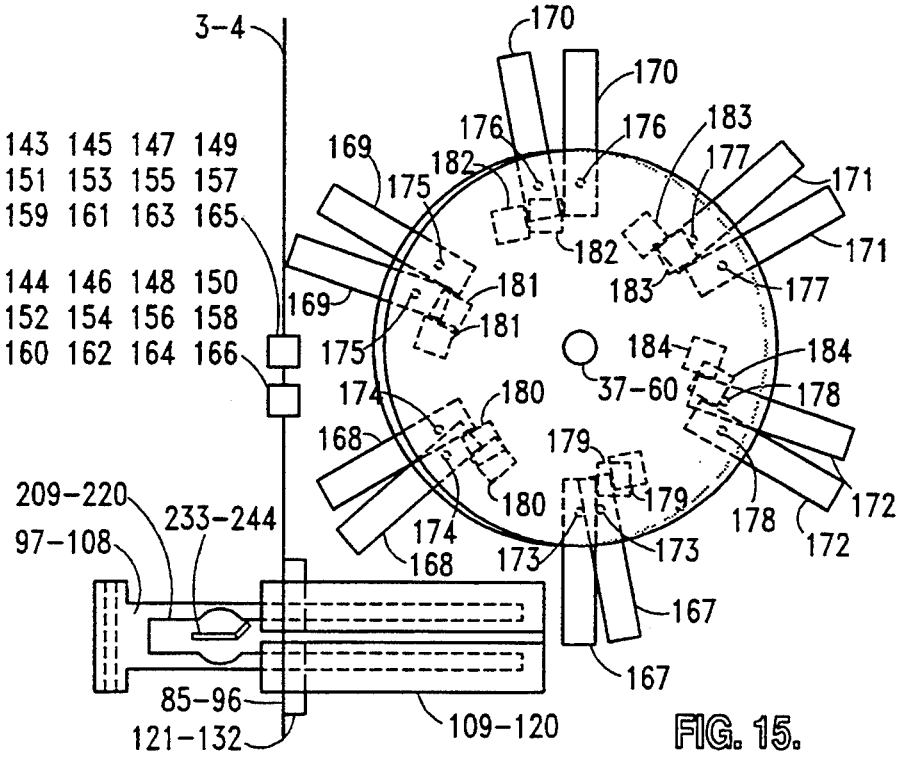
FIG. 15 is a perspective side view of pairs of facing discs combined with a top view of coin slots contained in coin slot containers. This is a view of a section of the machine that is engaged to play the machine.

Referring to FIG. 15 there is illustrated a side view of pairs of facing discs combined with a top view of coin slots contained in coin slots containers. Shown are pairs of facing discs with the discs levers attached to their facing surfaces. This is a view of a section of the machine that is engaged to play the machine.

Figure 16:
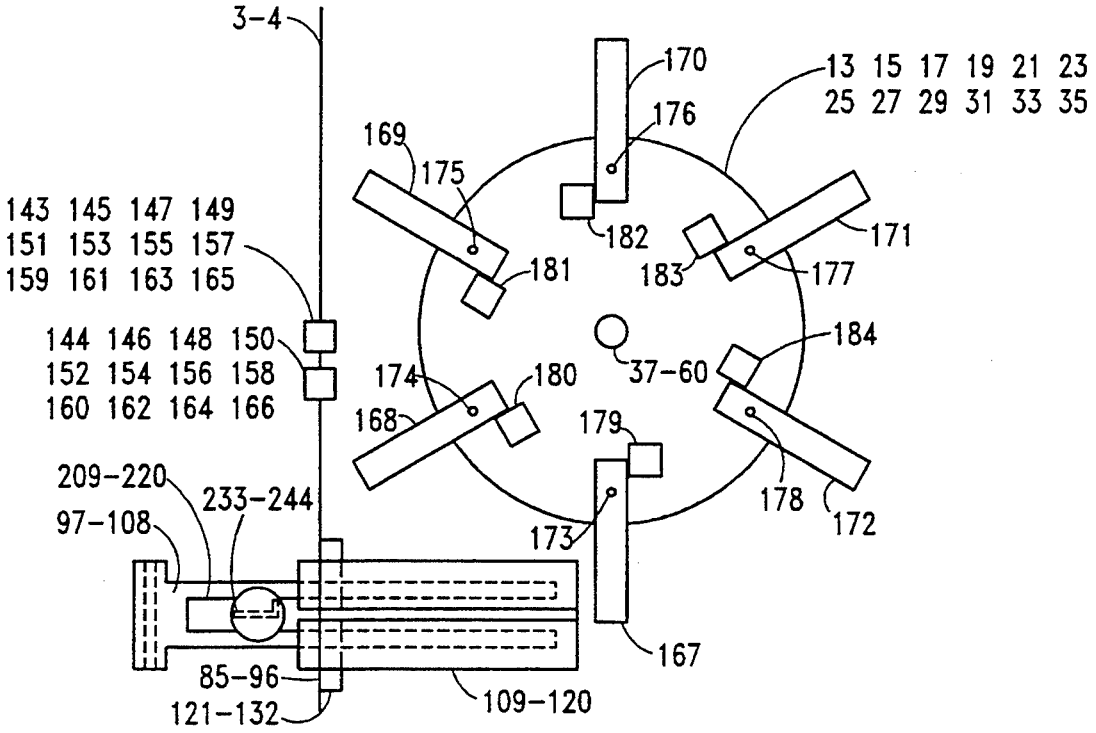
FIG. 16 is the same view as shown in FIG. 15 with one of the pairs of facing discs removed to clarify the engagement of the coin slots with the discs. Shown in the coin slots coin placements are coins placed to depress the coin slots elevator springs and braces from the elevated positions.

Referring to FIG. 16 there is illustrated the same view of an operating section as shown in FIG. 15 with one of the pairs of facing discs removed to clarify the engagement of the coin slots with the discs. The advancement and withdrawal of the coin slots during engagement with the discs levers rotate the pairs of facing discs and play the machine. The discs rotate and symbols on their edges appear in the symbols viewing ports. Two (2) matching symbols on pairs of facing discs appearing in the symbols viewing ports determine a win. Shown are coins placed in the coin slots coin placements to depress the elevator springs and braces so the coin slots can enter into the machine.

Figure 17:
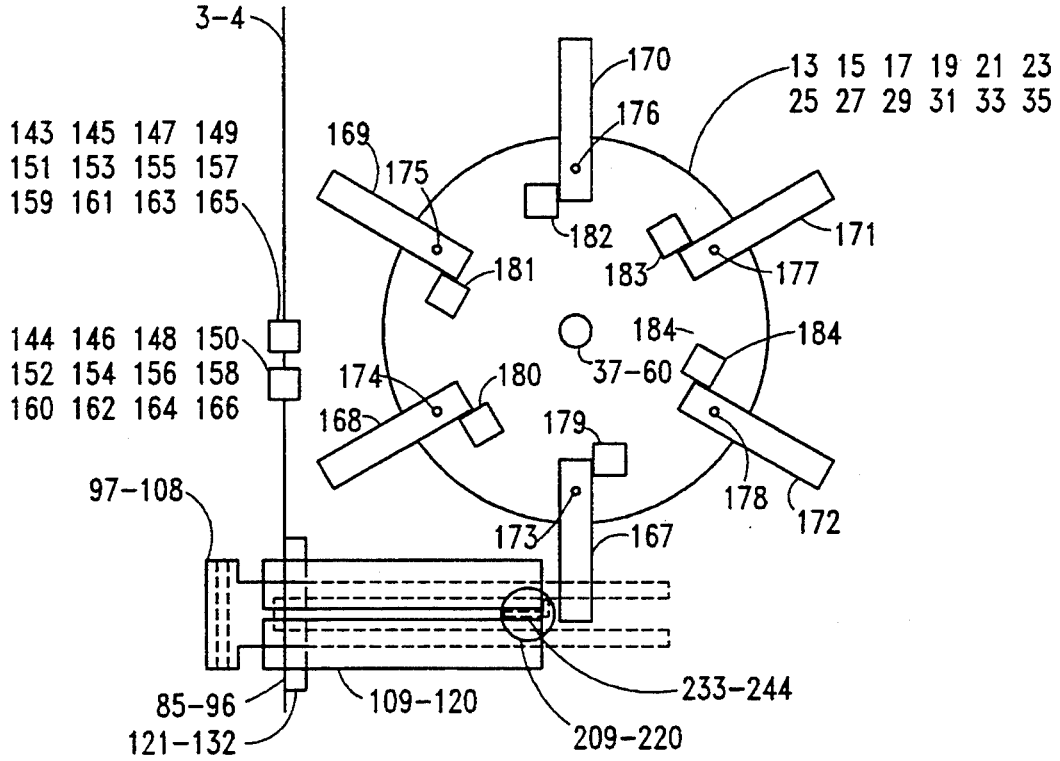
FIG. 17 is the same view as shown in FIG. 16 with the coin slots advanced to positions of engagement of the coins with the discs levers at the bottoms of the discs.

Referring to FIG. 17 there is illustrated the same view as shown in FIG. 16 with the coin slots advanced into the machine to engage the discs levers.

Figure 18:
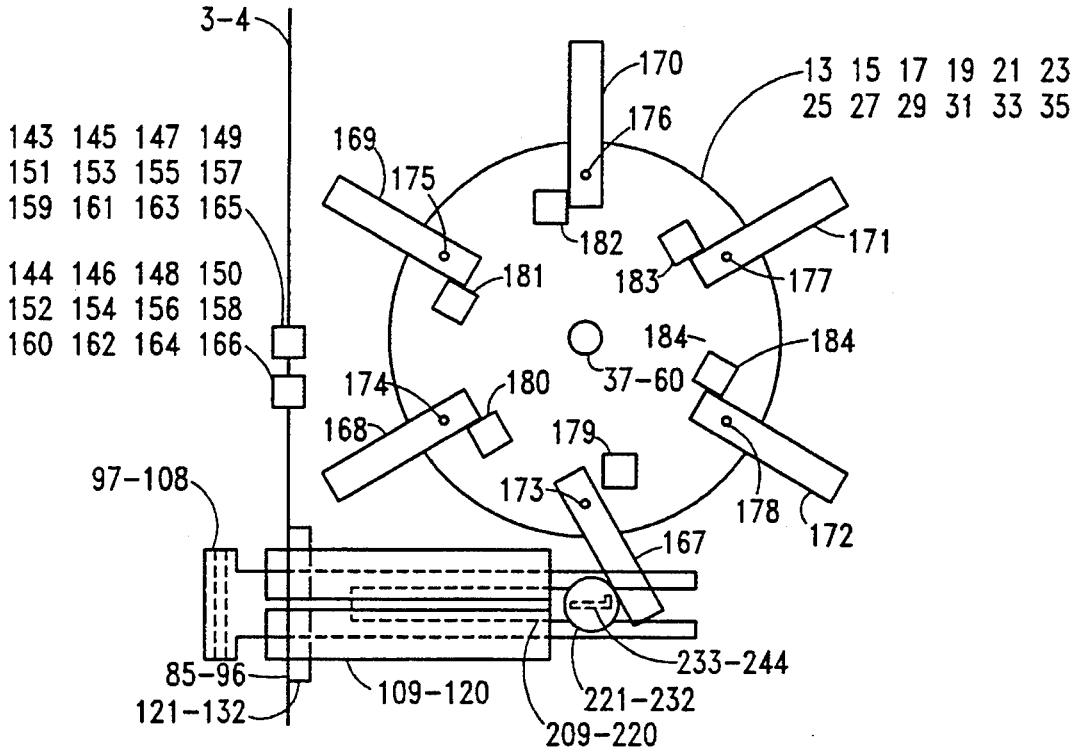
FIG. 18 is the same view as shown in FIG. 17 with the coin slots advanced farther until the coins engagement with the discs levers pivots the discs levers on the discs levers pivots to positions parallel to the coin slots.

Referring to FIG. 18 there is illustrated the same view as shown in FIG. 17 with the coin slots advanced farther into the machine. The coins in the coin slots coin placements engage the discs levers and pivot them parallel to the coin slots.

Figure 19:
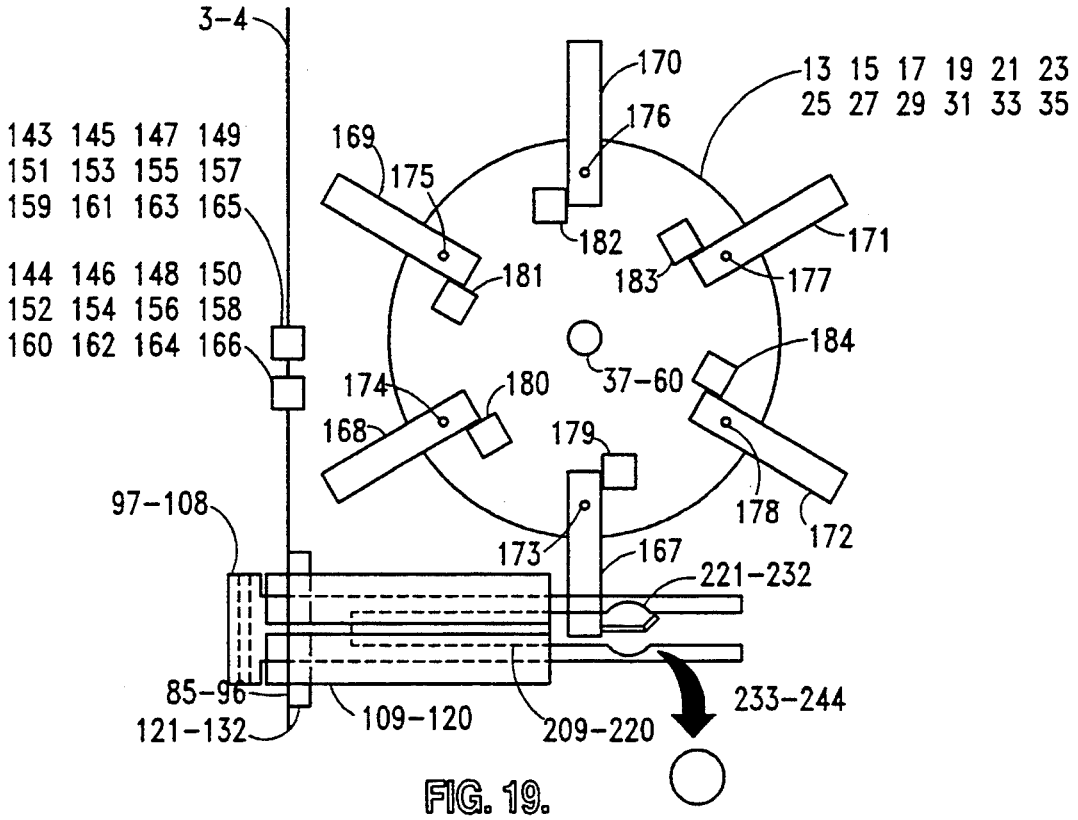
FIG. 19 is the same view as shown in FIG. 18 with the coin slots advanced farther until the coins in the coin slots coin placements go beyond the ends of the coin slots containers. The coins then drop out the bottoms of the coin slots coin placements. The discs levers upon release of the pressure from the coins drop from the parallel positions back to the original perpendicular positions inside the coin slots cutouts. The coin slots elevator springs and braces upon release from being depressed by the coins resume the elevated positions.

Referring to FIG. 19 there is illustrated the same view as shown in FIG. 18 with the coin slots advanced farther until the coins in the coin slots coin placements go beyond the ends of the coin slots containers. The coins then drop out the bottoms of the coin slots coin placements. The discs levers upon release of the pressure from the coins drop from the parallel positions back to the original perpendicular positions inside the coin slots cutouts. The coin slots elevator springs and braces upon release from being depressed by the coins resume the elevated positions.

Figure 20:
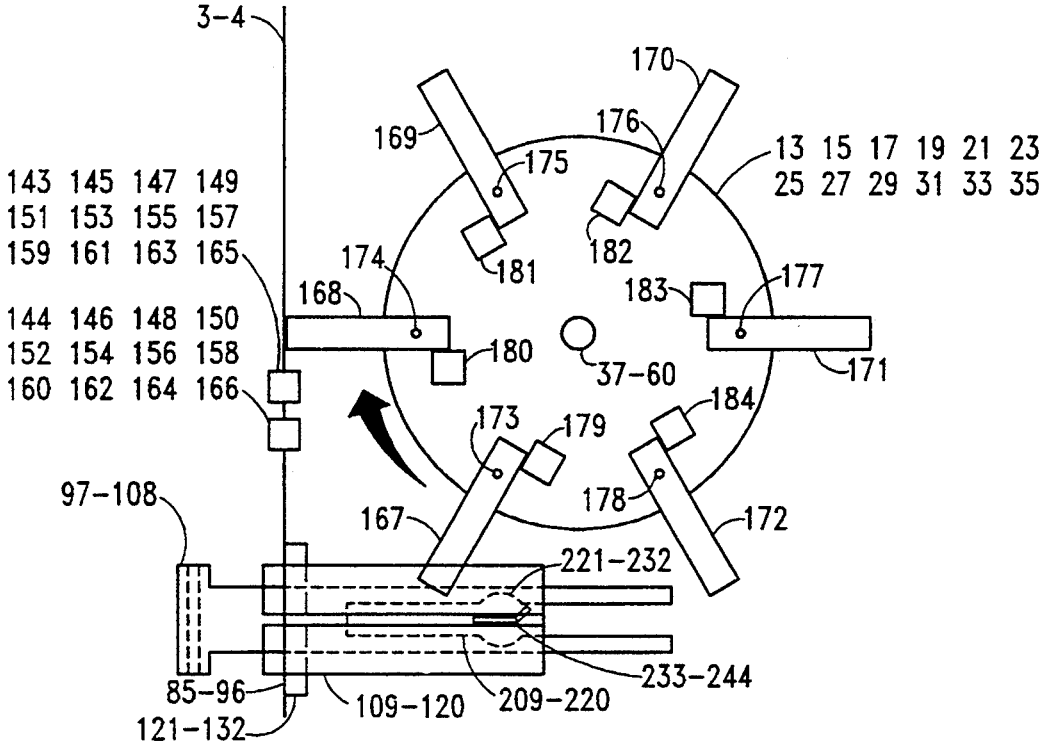
FIG. 20 is the same view as shown in FIG. 19 with the coin slots being withdrawn. The elevated coin slots elevator springs and braces engage the discs levers at the bottoms of the discs and force the discs levers against the discs levers stops attached to the discs and cause rotation of the discs in a clockwise direction.

Referring to FIG. 20 there is illustrated the same view as shown in FIG. 19 with the coin slots being withdrawn. The elevated coin slots elevator springs and braces engage the discs levers at the bottoms of the discs and force the discs levers against the discs levers stops attached to the discs and cause rotation of the discs in a clockwise direction. This rotation in the clockwise direction of the discs causes the rotation of symbols on the edges of pairs of facing discs. Two (2) matching symbols appearing in the symbols viewing ports of pairs of facing discs determine a win.

Figure 2:
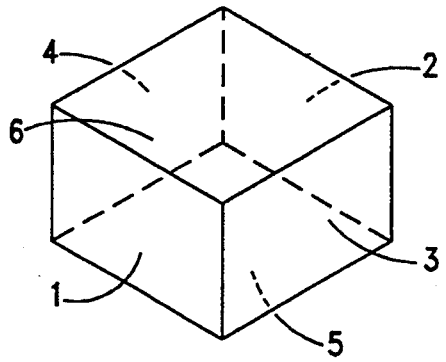
FIG. 2 is a perspective view of the left side, right side, front side, rear side, bottom side and top side of the machine.

Referring to FIG. 2 there is illustrated the machine showing the left side 1, right side 2, front side 3, rear side 4, bottom side 5 and top side 6.

I claim:

1. A double match jackpot machine comprising:

a front side and a rear side with each side having at least one identical mechanism, said identical mechanism having a plurality of sections that are capable of operating independently of each other and having a plurality of symbols viewing ports and coin slots containers extending through sides in the machine, each coin slots container having a coin slot with a coin placement for placing a coin and an elevator spring and brace that are attached to a bottom of the coin slots whereby said elevator spring and brace are depressed when a coin is placed thereon to allow the coin slot to enter the machine in a sliding fashion, each of said sections having a plurality of discs arranged in pairs such that they can rotate at random without control by gears, said discs further having sides and edges and are rotatably mounted upon a bar such that the edges can be viewed through the symbols viewing ports, said bar passes through a center hole provided in each disc side and is mounted to the machine, the discs further have a plurality of pivotally mounted discs levers attached to said sides which are contacted by the coin slots when they enter the machine in a sliding fashion to impart rotation to the discs and further have symbols on the edges such that they can be seen through said symbols viewing ports, a plurality of attachment rods, each coin slot further having handles with holes through which said attachment rods may pass to adjoin a plurality of sections of the mechanisms such that a plurality of coin slots may enter the machine simultaneously to impart rotation to the discs.

* * * * *